United States Patent [19]

Rubik

[11] Patent Number: 4,685,680

[45] Date of Patent: Aug. 11, 1987

[54] FOLDABLE COMPOSITE SYSTEM

[75] Inventor: Ernő Rubik, Budapest, Hungary

[73] Assignee: 501 Rubik Studio, Budapest, Hungary

[21] Appl. No.: 903,575

[22] PCT Filed: Jan. 22, 1986

[86] PCT No.: PCT/HU86/00005

§ 371 Date: Jul. 28, 1986

§ 102(e) Date: Jul. 28, 1986

[30] Foreign Application Priority Data

Mar. 29, 1985 [HU] Hungary ..... 1211/85

[51] Int. Cl.[4] ..... A63F 9/08

[52] U.S. Cl. ..... 273/155; 16/227; 16/366; 160/129; 160/135; 160/185; 160/231 A; 272/8 R; 428/12; 446/487; 446/490

[58] Field of Search ..... 16/227, 366; 52/645, 52/646; 160/129, 135, 136, 137, 185, 229 R, 231 R, 231 A; 272/8 R, 8 N; 273/153 S, 155; 428/12; 446/109, 119, 487, 490

[56] References Cited

U.S. PATENT DOCUMENTS

| | | | |
|---|---|---|---|
| 1,278,701 | 9/1918 | McIntire . | |
| 2,245,875 | 6/1941 | Rutherford . | |
| 3,487,578 | 1/1970 | Sudermann . | |
| 3,596,396 | 8/1971 | Thomson . | |
| 3,628,261 | 12/1971 | Thompson . | |
| 3,751,760 | 8/1973 | Wakeman | 16/227 |
| 4,147,198 | 4/1979 | Ytter | 160/135 |
| 4,183,166 | 1/1980 | Borner . | |
| 4,429,878 | 2/1984 | Asao . | |
| 4,466,799 | 8/1984 | Argiro . | |

OTHER PUBLICATIONS

Games & Puzzle, Sep. 1976, p. 33.

*Primary Examiner*—Anton O. Oechsle

*Attorney, Agent, or Firm*—Edward J. Handler; Joseph E. Root

[57] ABSTRACT

A composite array consists of plate-like elements or solid bodies interconnected by endless filaments. The front and rear surfaces of each element are provided with grooves, the grooves being divided in two groups, with grooves of each group running parallel with one another. The filaments lie within the grooves and are not attached to the elements. The filaments are arranged upon the elements so that each filament, upon reaching a lateral side of an element, is led into a groove on the opposite surface of the array. If the lateral side lies at the outmost edge of the array, the grooves are of different direction, while at lateral sides forming a line of contact, the grooves run in the same direction. On one or both surfaces of the elements, markings, numbers, letters, text or pattern elements may be found, for differentiating and determining the elements' positions.

13 Claims, 9 Drawing Figures

FOLDABLE COMPOSITE SYSTEM

TECHNICAL FIELD

The present invention relates to a composite array consisting of plate-shaped elements or solid bodies with straight lateral sides, interconnected by endless fastening means, the elements forming the array being rotatable along and around the lines of contact, respectively.

BACKGROUND ART

Constructions are known which allow the rotatable interconnection of different elements and components, rotatable in relation to one another. One of the most widely known solutions is represented by the hinge joints interconnecting the sides of windows and door-leaves, generally consisting of a pivot and the interconnected part mounted so as to be rotated about the pivot. These types of mechanical hinges enable rotating, but only in one direction. U.S. Pat. No. 4,236,560 discloses a case or wallet consisting of a lid and a frame forming the casing proper, provided with a covering held in position in the frame by a double clamping action between the frame and an insert. The latter element is held in position by tongues or lugs bent out of a leg of the frame and bearing against the insert. Thus, a clamping action along the edge of the covering is accomplished along two lines extending substantially parallel to each other around the entire edge of the covering. Naturally, the axis of rotation does not change in this case. Mechanical hinges allowing bidirectional rotation have been also developed, such as the so-called Bommer-hinges used on swing-doors, rigidly formed on places of rotation.

Hinges without pivots are also known. For example, so-called bend-hinges are mostly used for interconnecting the elements of folding screens, wallets or illusionists, etc. The common characteristic of such solutions lies in the fact that the hinges are fixed to the elements displacing in relation to each other; such hinges do, however, simultaneously enable a multiaxial displacement, in the form of a rotary motion. The hinges are parallel and run perpendicular to the axis of rotation. The hinges are flexible elastic straps, made of leather or textile, etc.

U.S. Pat. No. 4,162,648 disclosed an apparatus having a form removably receivable in a carton or the like to maintain the carton in a rigidly erect condition. A frame having side portions bounds an internal receptacle dimensioned to receive the carton in removably fitted relation therein, and side portions having corresponding edges delineate a line along which the carton is severed to convert the carton to a preselected configuration. In this case the folding is performed along the predetermined edges, and such folding cannot be repeated or changed.

German Pat. No. DE-AS 22 56 452 disclosed a looping and clamping device, used for lifting or holding loads. This device consists of a closed endless strap, connected to relatively less flexible straps. At the ends of the device, means ensuring a releasable connection are arranged. Strap-loops pass across the surface of the objects, but such straps are not fixed thereto.

Different recreational objects are also known in which folding plays an important role. Such a puzzle is disclosed, for example, in U.S. Pat. No. 3,892,411. The puzzle consists of a plurality of pivotal transparent strip members with indicia thereon. The strips are arranged around the edges of a square playing surface and are deployable in a preselected order to achieve a solution in an overlapped relationship such that the respective indicia are disposed in an alternating sequence.

U.S. Pat. No. 4,429,878 discloses a foldable puzzle card comprising four elongated rectangular strips, each including four equal card boards foldably connected with each other. The four strips are disposed to form a rectangular frame, and means are provided for foldably connecting a card board on both sides of one strip with end card boards on both sides of the other two strips. The strips are arranged perpendicularly to cause interconnected end card boards to overlap each other. Front and rear surfaces of each card board are provided with predetermined patterns so that suitable folding of the strips forms a desired pattern.

DISCLOSURE OF THE INVENTION

It is an object of this invention to provide a composite array by connecting a plurality of rigid plate-like elements having straight lateral sides with endless fastening means. Axes of rotation are formed along the lines of contact of the elements so interconnected, and such elements can be rotated around axes.

A further object of the invention is to provide a composite array in which endless fastening means are not fixed to the elements to be connected but pass on the surface thereof, to enclose such elements.

According to the invention the objects are achieved by providing a composite array consisting of rigid plate-like elements or solid bodies with straight lateral sides interconnected by endless fastening means passing across both surfaces of the plate-like elements. Identically arranged grooves, divided in two groups and mutually parallel within each group are provided. The grooves of the two groups intersect the lateral sides of an element to enclose an acute angle.

Endless fastening means are arranged in the grooves, independent of the elements to be connected and spanning the elements in a symmetrical arrangement. When an endless fastening means reaches a lateral side of an element, it passes into the groove on the opposite surface of an element. If such lateral side lies at the outside of the composite array, the fastening means passes into a groove of different direction, while in the case of lateral sides forming a line of contact with an adjacent element, the fastening means passes into a groove running in the same direction. As a consequence, on the surface of each element all fastening means run in parallel. Fastening means cross the lines of contact between adjacent elements at least three times, wherein one crossing is of opposite direction to the other two.

As a fastening means, any elastic filament can be used, preferably having a circular cross-section. An elastic strip with a a quadratic cross-section can be also used. Hereinafter, the term "filament" will be employed to designate an endless fastening means, it being understood that a variety of such endless fastening means may be used in practicing the invention.

The cross section of the grooves in the surface of the plate-like elements is formed in compliance with the cross-section of the filament, and in such a manner, that the filaments should lie beneath the plane of the surface of the plate-like elements, or at most to the level of such plane.

The number of the plate-like elements may amount to two or more—and theoretically may be of infinite number. The size and shape of the elements are preferably identical.

In order to facilitate rotation along the lines of contact, lateral sides of the plate-like elements are bevelled or rounded-off.

In a preferred embodiment of the invention, one or both surfaces of the elements may carry markings, numbers, letters, etc., of a text or a pattern for differentiating and determining their position within the array.

In another preferred embodiment four plate-like elements are interconnected with four filaments, the plate-like elements being squares of identical size and configuration. The grooves formed in the element surfaces enclose a right angle, and the angle enclosed by the intersection of the grooves with the lateral edges equals 45.

In another preferred embodiment the elements are interconnected by pairs. An embodiment is also possible wherein the elements are fastened by fours.

The composite array according to the invention ensures that the plate-like elements, having been connected as described, form axes of rotation along their lines of contact, about which they can be rotated. When the array is rearranged and elements come into contact with other plate-like elements, new axes of rotation may be formed, replacing the former axes. Thus, axes of rotation "migrate". After "migrating", an axis of rotation lies at a right angle to its previous position.

As mentioned above, the filaments are not fixed to the plate-like elements, but pass within the grooves formed on the surface thereof, spanning the plate-like elements.

The invention, by the aid of different markings, letters, numbers, colours, text or patterns carried by the plate-like elements, can form entertaining games, the complexity of the game depending on the number of elements connected. As will become obvious from FIG. 9, by manipulating the plate-like elements not only planar but also three-dimensional formations can be obtained, making the game even more diversified. Making a puzzle is only one of the possible fields of application; in the same manner, arrays for advertising and publicity purposes, as well as educational devices, can be developed. Also, by selecting other sizes and materials, partition walls, decorative objects and packing materials can be obtained.

An important advantage of the composite array of the present invention lies in the fact that it does not comprise fixed elements; accordingly, complicated assembly is not required. Also metal elements are not contained, and therefore protection against corrosion becomes superfluous. Useful life is long, as components tending to fail are not contained. As plate-like elements are preferably made of a synthetic material, formation of grooves can be performed with a relatively simple mass-production process.

BRIEF DESCRIPTION OF THE DRAWINGS

Further objects and advantages of the invention can be more fully understood from the following detailed description of some preferred embodiments of the invention, which refers to the accompanying drawings, wherein.

BEST MODE OF CARRYING OUT THE INVENTION

Figure 1:
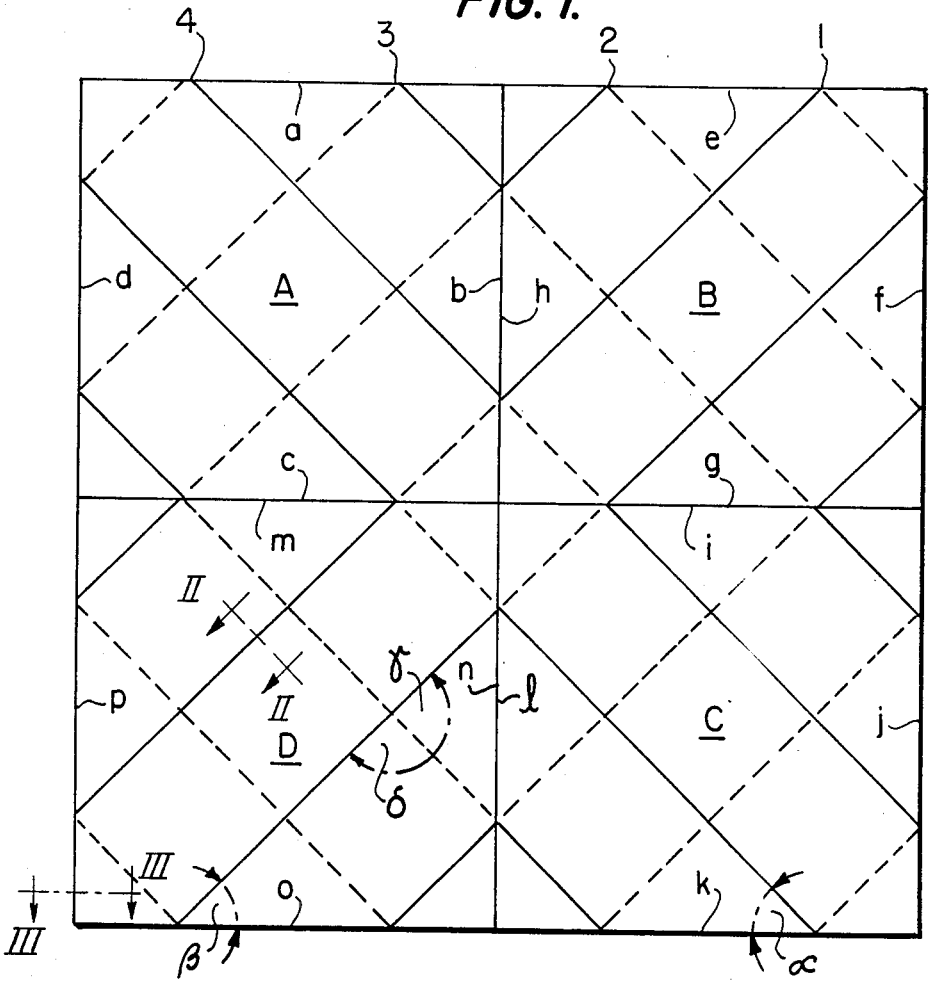
FIG. 1 is a top view of a composite array according to the invention, consisting of four elements.

Referring to FIG. 1, a composite array is composed of four elements A, B, C and D. Lateral sides of element A are indicated a, b, c, d; lateral sides of the element B as e, f, g and h; lateral sides of element C as i, j, k, l; and lateral sides of the element D as m, n, o and p. The four plate-like elements are interconnected by means of the annular spliced flexible fastening means filaments 1, 2, 3 and 4, all having a circular cross-section. Grooves 5 are formed in both surfaces of the elements A, B, C and D divided in two groups. Within each group, grooves are mutually parallel and the lateral sides to enclose angles alpha and beta.

Grooves belonging to the two groups intersect each other at angles gamma and delta. The filaments 1, 2, 3, 4 are arranged in the grooves such that where indicated in FIG. 1 with a solid line, the filaments lie on the upper surface of an element, and where indicated with a dotted line, they lie on the lower surface of the elements. As seen, the filaments pass across the two surfaces in opposite directions.

When a filament arrives at a lateral side, it passes into a groove 5 on the other surface of the array. If the lateral side is located at the outmost part of the array, the direction of the groove 5 into which the fastening means passes lies on the other surface of the same element and deviates at an angle gamma or delta. Conversely, at the lateral sides forming a line of contact with another element, the groove into which the fastening means passes is located on the other surface of the array, but on the adjoining element and running in the same direction as the groove from which the filament emerged.

Figure 2:
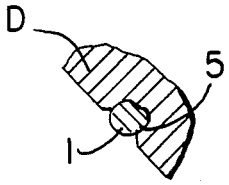
FIG. 2 is a partial sectional view taken along section lines A—A of FIG. 1.

FIG. 2 illustrates an enlarged view of the groove 5. It can be seen that the groove 5 is formed with sides perpendicular to the element surface, with a bottom part being parallel with the element surface and outwardly slanting wall-parts connecting the bottom-part and the sides. The filament in FIG. 2 has a circular cross-section, but in practice a different cross-section is also permissible. Grooves 5 are formed to a depth such that filaments cannot emerge from the surface of the elements.

Figure 3:
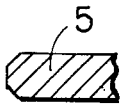
FIG. 3 is a partial sectional view taken along section lines B—B of FIG. 1.
Figure 4:
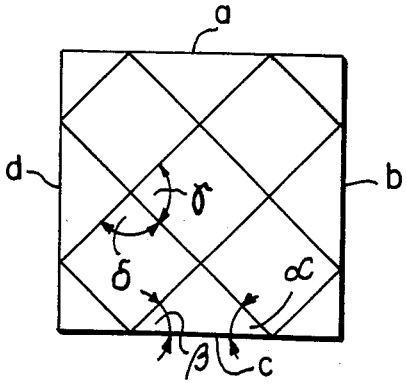
FIG. 4 illustrates schematically the top view of an element of the array according to FIG. 1.

FIG. 3 gives an enlarged sectional view from the lateral side p. It can be seen that the element is bevelled along the lateral sides, thus facilitating rotation of adjacent lateral sides of abutting elements.

In the array according to FIG. 1, the arrangement of the filaments enables rotation about the axes bn-hl or eg-mi. In the former case the lateral sides ae-ok form a new axis of rotation, so the lateral sides b-h and n-l forming the earlier axis bn-hl, as well as lateral sides c-m and g-i, can be displaced in relation to each other along the axes ae-ok. As a result, a prism will be obtained, being open at the bottom and the top.

This prism can be extended by pulling apart the lateral sides c-m and g-i resulting in a new axis of rotation—now along the sides df-pj—by rotating elements A, B, C and D around this new axis of rotation. The elements can be spread apart, to a configuration similar to that of FIG. 1, but the order of sequence and position of the elements—and thus the position of the lateral sides a-p—will change also.

Similar rotations can be performed if one begins rotating about axis eg-mi or the axis bm-hl. Here, however, elements A, B, C and D are not rotated upwards (in a direction out of the page, toward the reader), but downwards. Now the following will happen: If the elements are rotated downwards about axis om-hl, a new axis of rotation is formed along lateral sides eg-mi, around which the elements A, B, C and D can be spread apart in four directions, i.e. in a star-shape. When manipulated further, two flat portions are obtained, which can be folded apart into the starting shape along the new axis of rotation formed along the lateral sides df-jp. As with the previous rotating operation, elements A, B, C and D and similarly, lateral sides a-p, are arranged quite differently from the initial pattern.

In this manner, graphic elements can be disposed on the surfaces of the plate-like elements to form a uniform pattern in the starting position. Then, by performing the previously described manipulations, the pattern elements can be optionally mixed to produce quite a new pattern, totally different from the original one. Afterward, further manipulation may restore the starting position. The markings, symbols, letters, numbers, pattern elements, etc., arranged on the surfaces of the elements A, B, C and D serve for control. In such a manner a most entertaining puzzle or an attention-getting advertising device is made possible.

The composite array as illustrated in FIGS. 1 to 3 can be considered as a basic embodiment; in this embodiment the lateral sides of the plate-like elements are of equal length. Based on the principles of geometry, it should be understood, the grooves 5 run perpendicular to each other within the single groups, i.e., gamma=-delta=90. Therefore, it is also clear that the angles enclosed by the lateral sides are equal; that is, angle alpha=beta=90.

Figure 5:
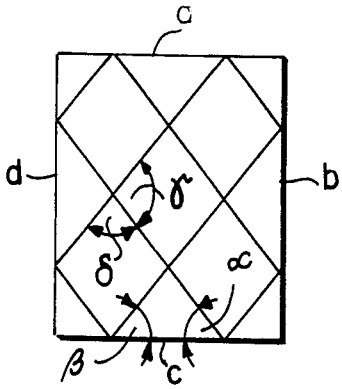
FIG. 5 is a top view of a part of an array according to the invention, somewhat differing from that according to FIG. 1.

In FIG. 5 an alternative plate-like element is seen, in which lateral sides a and c are of equal length, but these sides are shorter than lateral sides b and d, which are also of identical length. From these illustrations, based on principles of geometry it can be understood that the angles gamma and delta enclosed by the groups of the grooves 5 are different, so the angles alpha and beta—which, of course, are identical—differ from the angles alplha' and beta 'enclosed by the grooves 5 and the lateral sides b and d. Apart from the difference in side lengths, the fastening arrangement is carried out in accordance with the technique described in connection with FIG. 1. This technique yields the same possibilities of rotation, based on conformity to the rules set forth, as the methods of rotation detailed in connection with FIG. 1.

Figure 6:
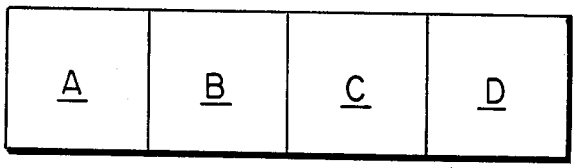
FIG. 6 illustrates schematically an array connected from four elements, wherein the elements are arranged in a linear manner.
Figure 7:
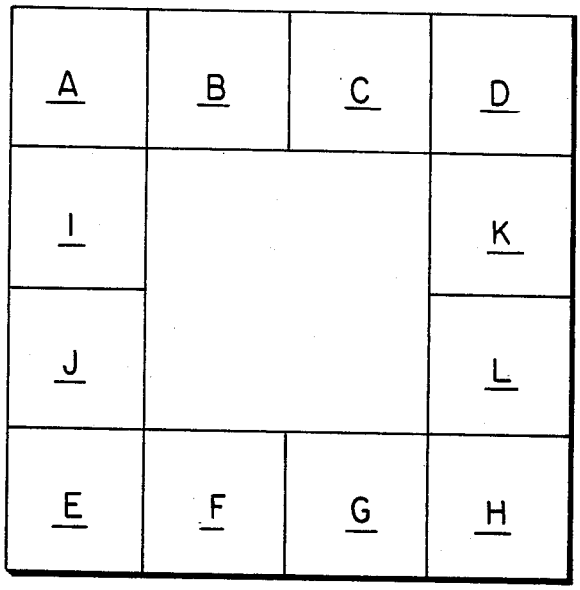
FIG. 7 shows an array consisting of twelve elements, wherein the elements are arranged in a closed linear form.

A composite array according to the invention can be arranged with elements connected in a serial, linear form—as seen in FIG. 6—or as a closed line—seen in FIG. 7. A combination of those methods is also possible, producing the flat array of FIG. 8. Also, manipulation of any of the forms discussed above can obtain a three-dimensional object, such as that shown in FIG. 9.

In the embodiment seen in FIG. 6, in which the plate-like elements A, B, C and D are linearly arranged, connection by the filaments may take place by pairs of elements, such as by linking elements AB and CD, and then connecting those subassemblies by joining element B to element C.

The arrangement in a closed line, as seen in FIG. 7, consists of twelve plate-like elements, indicated A to L. In this case, assembly of the completed unit with filaments may take place by four-element subunits, so that elements ABCD and EFGH are linked, and further assembly yields units AIJE and DKLH. Connection by pairs of elements, according to the description in connection with FIG. 6, is also possible.

Figure 8:
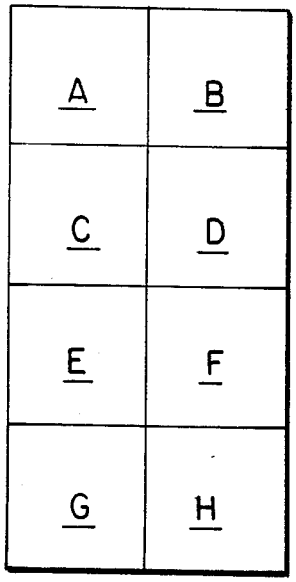
FIG. 8 shows a top view of a array connected from eight elements, in a flat double-row arrangement.

The flat arrangement of FIG. 8 consists of eight plate-like elements indicated A to H. In this embodiment, attachment of the filaments may be accomplished in four-part subassemblies by constructing units ACEG, and BDFH, and then connecting elements CDEF.

Figure 9:
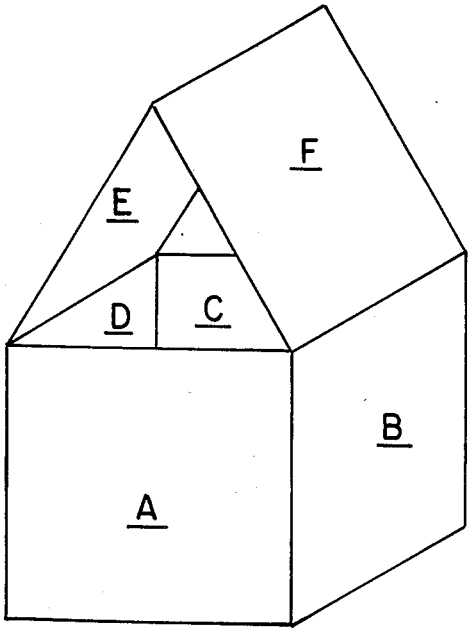
FIG. 9 shows a array composed of six elements, wherein a three-dimensional arrangement was formed from the planar arrangement.

Finally, in the embodiment shown in FIG. 9, the three-dimensional arrangement includes six connected plate-like elements. This arrangement can be formed from a planar arrangement and vice versa.

The embodiments seen in the Figures serve as examples and may be combined in several ways. Further embodiments are also possible without departing from the scope of protection defined in the claims appended hereto. Therefore, no limitations should be construed from such examples regarding the material of the plate-like elements or the filaments. Also, dimensions of the elements can be chosen optionally, in accordance with the application intended.

Although the composite array of the present invention was discussed in particular for the purpose of games and advertisements, it can be successfully used for other purposes, such as partition elements, packing materials, or for decorative purposes.

In a further advantageous embodiment, the plate-like elements are made of two transparent plates each, and in between the elements are carried graphic inserts, with markings, numbers, letters, text or patterns, serving to differentiate or determine the position of the elements. In this embodiment, the patterns can be seen from one or both sides.

I claim:

1. A composite array, comprising:

a plurality of array elements, said elements being generally plate-like in form, each said element including upper and lower generally flat surfaces;

first and second groups of grooves formed in each said surface,members of each said group being mutually parallel, with grooves of said first group intersecting grooves of said second group to enclose angles, grooves formed in one said surface being in overlying registration with grooves on the other said surface;

sides, surrounding and joining said surfaces, each side including side intersection points at which at least two said grooves on each said surface mutually intersect and intersect said side of each said element abutting at least one other said element;

fastening means looped on said elements for fastening said elements within the array, said fastening means disposed in preselected ones of said grooves and forming at least one hinge point between each said element and at least one other said element, enabling a selected element to rotate about said hinge point into a position in contact with said other element, further rotation of said element in a selected direction different from the first said rotation causing said hinge point to migrate to different sides of both said elements, thereby changing the sides upon which the two said elements abut.

2. A composite array, comprising:

a plurality of array elements, generally plate-like in form, each said element including upper and lower generally flat surfaces;

first and second groups of grooves formed in each said surface, members of each said group being mutually parallel, and grooves of said first group intersecting grooves of said second group to enclose angles, grooves formed in one said surface being identical to grooves on the other said surface;

sides, surrounding and joining said surfaces, each side including side intersection points at which at least two said grooves on each said surface mutually intersect and intersect said side, said plates being arranged in an array of adjacent said plates, each said plate abutting at least one other said plate, adjoining sides of said abutting plates being aligned; and a plurality of endless fastening filaments, each filament having portions thereof within preselected said grooves, the path described by a said filament including first points, at which said filament passes from an upper surface groove to a lower surface groove on a single said plate, said filament path turning to enter a said groove of the opposite said group of said grooves on the opposite said surface in the course of said passage, and second points, each located on a said adjoining side wherein a first plate and a second plate abut, wherein two filament portions pass from said first plate to said second plate, one said filament portion passing from an upper surface on one said plate to a lower surface of the other said plate and the other said filament portion passing between opposite respective surfaces of each said plate, both said filament portions describing substantially straight lines with respect to said grooves.

3. The composite array of claims 1 or 2, wherein said array elements are identical.

4. The composite array of claims 1 or 2, wherein said array elements are quadrilateral.

5. The composite array of claims 1 or 2, wherein said array elements are square.

6. The composite array of claims 1 or 2, wherein said grooves mutually intersect at substantially 90 degree angles.

7. The composite array of claims 1 or 2, wherein said grooves intersect said sides at substantially 45 degree angles.

8. The composite array of claims 1 or 2, wherein said filaments are a synthetic material.

9. The composite array of claims 1 or 2, wherein said filaments are carried completely within said grooves.

10. The composite array of claims 1 or 2, wherein said sides containing said hinge points contain two said hinge points on each such side.

11. The composite array of claims 1 or 2, wherein said filament portions crossing at a said hinge point are portions of a single filament.

12. The composite array of claims 1 or 2, wherein said filament portions crossing at a said hinge point are portions of two separate filaments.

13. A composite array, comprising:

a plurality of plate-like elements, each said element being generally square and including upper and lower generally flat surfaces;

first and second groups of grooves formed in each said surface, each said group having four mutually parallel grooves, with grooves of said first group intersecting grooves of said second group to enclose angles of about 90 degrees, and grooves formed in one said surface being identical to grooves in the other said surface;

sides, surrounding and joining said surfaces, each side including side intersection points at which at least two said grooves on each said surface mutually intersect at an angle of about 90 degrees and intersect said side at an angle of about 45 degrees, said plates being arranged in an array of adjacent said plates, each said plate abutting at least one other said plate, adjoining sides of said abutting plates being aligned; and a plurality of endless fastening filaments of a synthetic material of circular cross-section, each filament having portions thereof lying within preselected said grooves, the path described by a said filament including anchor points, at which said filament passes from an upper surface groove to a lower surface groove on a single said plate, said filament path turning to enter a said groove of the opposite said group of said grooves on the opposite said surface in the course of said passage, and hinge points, each located on a said adjoining side wherein a first plate and a second plate abut, wherein two filament portions pass from said first plate to said second plate, one said filament portion passing from an upper surface on one said plate to a lower surface of the other said plate and the other said filament portion passing between opposite respective surfaces on each plate, both said filament portions describing substantially straight lines with respect to said grooves.

* * * * *